US006380086B1

(12) United States Patent
Robinson et al.

(10) Patent No.: US 6,380,086 B1
(45) Date of Patent: Apr. 30, 2002

(54) HIGH-SPEED PLANARIZING APPARATUS FOR CHEMICAL-MECHANICAL PLANARIZATION OF SEMICONDUCTOR WAFERS

(75) Inventors: Karl M. Robinson; Hugh Stroupe, both of Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/132,693

(22) Filed: Aug. 11, 1998

Related U.S. Application Data

(63) Continuation of application No. 08/574,492, filed on Dec. 19, 1995, now Pat. No. 5,792,709.

(51) Int. Cl.[7] ..... H01L 21/302
(52) U.S. Cl. ..... 438/692; 156/345; 451/288
(58) Field of Search ..... 156/345; 216/88–90; 451/288–292; 438/690–692

(56) References Cited

U.S. PATENT DOCUMENTS

| | | | | |
|---|---|---|---|---|
| 3,593,462 A | * | 7/1971 | Ryll | 451/324 |
| 3,665,648 A | | 5/1972 | Yamanaka | 451/292 |
| 3,793,779 A | | 2/1974 | Perella | 451/292 |
| 4,557,785 A | | 12/1985 | Ohkuma | 156/345 |
| 4,663,890 A | | 5/1987 | Brandt | 451/278 |
| 5,232,875 A | | 8/1993 | Tuttle et al. | 451/270 |
| 5,360,509 A | | 11/1994 | Zakaluk et al. | 156/645.1 |
| 5,399,233 A | | 3/1995 | Murazumi et al. | 156/635 |
| 5,478,435 A | | 12/1995 | Murphy et al. | 156/636.1 |
| 5,533,923 A | | 7/1996 | Shamouilian et al. | 451/41 |
| 5,542,874 A | | 8/1996 | Chikaki | 451/289 |
| 5,554,064 A | | 9/1996 | Breivogel et al. | 451/41 |
| 5,597,346 A | | 1/1997 | Hempel, Jr. | 451/287 |
| 5,931,722 A | * | 8/1999 | Ohmi et al. | 451/271 |
| 5,934,979 A | * | 8/1999 | Talieh | 451/41 |

* cited by examiner

*Primary Examiner*—Felisa Hiteshew
*Assistant Examiner*—Kin-Chan Chen
(74) *Attorney, Agent, or Firm*—Dorsey & Whitney LLP

(57) ABSTRACT

The present invention is a high-speed planarizing machine with a platform that holds the wafer stationary during planarization, and a carrier positioned opposite the platform. The carrier rotates about an axis and translates in a plane that is substantially parallel to the wafer. A polishing pad is attached to the carrier and positioned opposite the wafer. The carrier rotates and translates the polishing pad across the wafer while the wafer is held stationary.

11 Claims, 6 Drawing Sheets

HIGH-SPEED PLANARIZING APPARATUS FOR CHEMICAL-MECHANICAL PLANARIZATION OF SEMICONDUCTOR WAFERS

CROSS-REFERENCE TO RELATED APPLICATION

This application is a continuation of U.S. patent application Ser. No. 08/574,492, filed Dec. 19, 1995, and issuing as U.S. Pat. No. 5,792,709 on Aug. 11, 1998.

TECHNICAL FIELD

The present invention relates to a high-speed wafer planarizing machine for use in chemical-mechanical planarization of semiconductor wafers.

BACKGROUND OF THE INVENTION

Chemical-mechanical planarization ("CMP") processes are used to remove materials from the surface layer of a wafer in the production of ultra-high density integrated circuits. In a typical CMP process, a wafer is pressed against a slurry on a polishing pad under controlled chemical, pressure, velocity and temperature conditions. Current polishing pads have diameters of approximately two feet, and they are rotated on a platen at approximately 20 to 40 rpm. Wafers typically have diameters of 6 to 8 inches, and they are simultaneously rotated at approximately 10 to 30 rpm and translated across the polishing pad. The slurry solution contains small, abrasive particles that mechanically remove material from the surface layer of the wafer as the wafer is moved over the pad.

After a wafer is planarized, it is removed from the polishing pad and rinsed with deionized water to remove residual particles on the surface of the wafer. Wafers are typically re-planarized a second time to obtain a uniformly planar surface at a desired end point, and then they are removed from the planarizing machine and re-rinsed with deionized water.

CMP processes must consistently and accurately create a uniform, planar surface on the wafer at a desired endpoint. Many microelectronic devices are typically fabricated on a single wafer by depositing layers of various materials on the wafer, and manipulating the wafer and the other layers of material with photolithographic, etching, and doping processes. In order to manufacture ultra-high density integrated circuits, CMP processes must produce a highly planar surface so that the geometries of the component parts of the circuits may be accurately positioned across the full surface of the wafer. Integrated circuits are generally patterned on a wafer by optically or electromagnetically focusing a circuit pattern on the surface of the water. If the surface of the wafer is not highly planar, the circuit pattern may not be sufficiently focused in some areas, resulting in defective circuits. Therefore, it is important to accurately planarize a uniformly planar surface on the wafer.

One problem with current CMP planarizers is that they do not produce a wafer with a sufficiently uniform surface because the relative velocity between the wafer and the pad changes from the center of the wafer to its perimeter in proportion to the radial distance from the center of the wafer. The center-to-edge velocity profile generally causes the perimeter of the wafer to have a different temperature, and thus a different polishing rate, than the center of the wafer. Accordingly, it would be desirable to reduce or eliminate the center-to-edge velocity profile across the wafer.

In the competitive semiconductor industry, it is also highly desirable to maximize the throughput of CMP processes to produce accurate, planar surfaces as quickly as possible. The throughput of CMP processes is a function of several factors, including the rate at which the thickness of the wafer decreases as it is being planarized ("the polishing rate"), and the ability to perform the rinsing and planarizing steps quickly. A high polishing rate generally results in a greater throughput because it requires less time to planarize a wafer. Similarly, performing the planarizing and rinsing steps quickly reduces the overall time it takes to completely planarize a wafer. Thus, it would be desirable to maximize the polishing rate and minimize the time required to perform the planarizing and rinsing steps.

Another problem with current CMP processes is that the polishing rates are limited because the center-to-edge velocity profile across the wafer limits the maximum velocity between the wafer and polishing pad. As stated above, the polishing rate is a function of the relative velocity between the wafer and the pad. Rotating the wafer at higher speeds, however, only exacerbates the center-to-edge velocity profile across the surface of the wafer because the difference between the linear velocity at the perimeter of the wafer and the center of the wafer increases as the angular velocity of the wafer increases. Accordingly, it would be desirable to provide a wafer planarizer that increases the maximum velocity between the wafer and the pad without increasing the center-to-edge velocity profile across the wafer.

Still another problem of the current CMP processes is that the procedure of planarizing, rinsing, re-planarizing, and re-rinsing is time-consuming. In current CMP processes, the wafer is moved back and forth between the planarizing machine and a wafer rinser throughout the process. Each time the wafer is moved from the planarizer to the wafer rinser, an arm picks up the wafer and physically moves it over to the wafer rinser. The wafer planarizer is idle while the wafer is being rinsed, and the wafer rinser is idle while the wafer is being planarized. In current CMP processes, therefore, either the wafer planarizer or the wafer rinser is idle at any given time. Thus, it would be desirable to provide a more efficient wafer planarizer and wafer rinser.

SUMMARY OF THE INVENTION

The inventive high-speed planarizing machine has a platform that holds the wafer stationary during planarization, and a carrier positioned opposite the platform. The carrier rotates about an axis and is translated in a plane that is substantially parallel to the wafer. A polishing pad is attached to the carrier and positioned opposite the wafer. The carrier rotates and translates the polishing pad across the wafer while the wafer is held stationary.

DETAILED DESCRIPTION OF THE INVENTION

Figure 1:
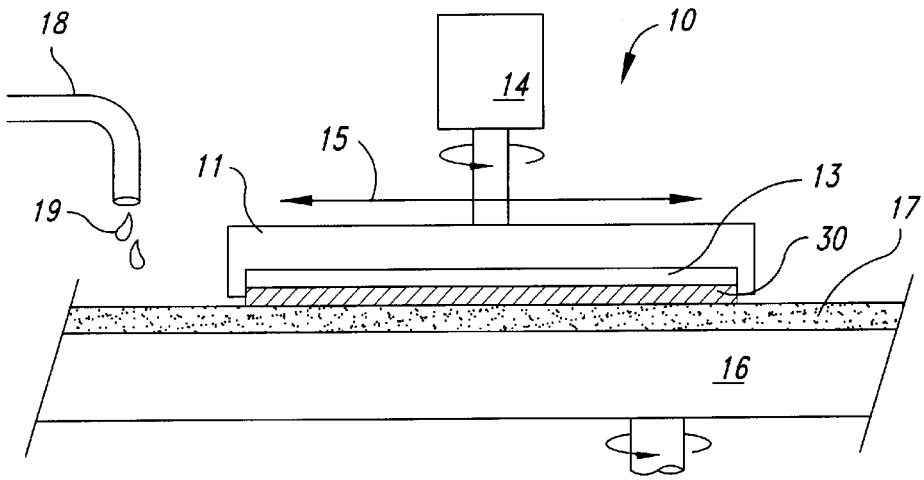
Fig. 1 (PRIOR ART)
FIG. 1 is a schematic cross-sectional view of a wafer planarizing machine in accordance with the prior art.
Figure 2:
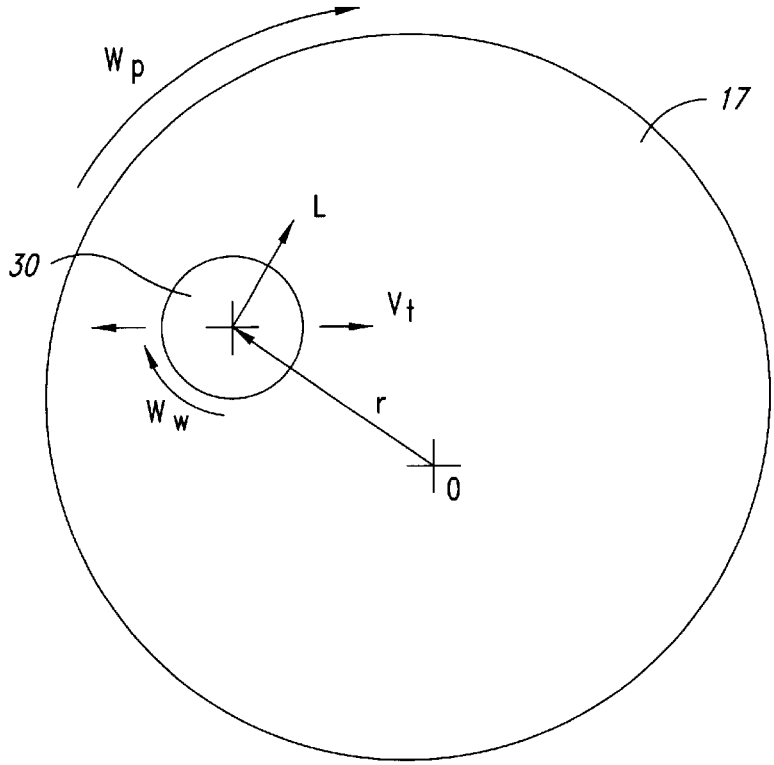
Fig. 2 (PRIOR ART)
FIG. 2 is a top view of a planarizing machine in accordance with the prior art.

The present invention provides a high-speed planarizing apparatus for planarizing semiconductor wafers that eliminates the center-to-edge velocity profile across the wafer. The wafer planarizing apparatus of the invention also simultaneously planarizes and rinses a number of wafers to provide parallel processing of a plurality of wafers. For the purposes of better understanding the present invention, "point velocity" is the relative linear velocity between a point on the wafer and the surface of the pad. Each point on the wafer in contact with the pad has a point velocity that is a function of the radial distance from the rotational axis of the pad and the translational velocity of the pad. One important aspect of the invention is to provide a planarizer in which the diameter of the polishing pad is less than the diameter of the wafer. Another important aspect of the invention is to hold the wafer stationary while moving such a small pad in an asymmetrical pattern across the surface of the wafer. By holding the wafer stationary and using a small pad, the average of the point velocities along a radius of the wafer are substantially random. The present invention, therefore, does not produce a center-to-edge velocity profile across the surface wafer. FIGS. 1 and 2 illustrate conventional planarizing machines, and FIGS. 3–8 illustrate planarizing machines in accordance with the invention. Like reference numbers refer to like parts throughout the various figures.

FIG. 1 illustrates a conventional planarizing machine 10 in accordance with the prior art. The planarizer has a rotating platen 16 and a wafer carrier 11 positioned opposite the platen 16. A large polishing pad 17 is placed on the top surface of the platen 16, and a wafer 30 is mounted to a mounting surface 13 of the wafer carrier 11. The diameter of the polishing pad 17 is approximately 2.0–3.0 feet, and the diameter of the wafer 30 is 6.0–8.0 inches. A slurry solution 19 is deposited onto the upper surface of the polishing pad 17 from a slurry pipe 18. In operation, the platen 16 rotates the polishing pad 17 at approximately 20 to 40 rpm, and an actuator 14 rotates the wafer 30 at approximately 10 to 30 rpm while translating the wafer 30 across the surface of the polishing pad 17.

FIG. 2 illustrates the basic principles of conventional CMP processes that produce a center-to-edge velocity profile across the surface of the wafer 30. The polishing pad 17 rotates at an angular velocity $W_p$ (rads./sec), and the wafer 30 rotates at an angular velocity $W_w$ (rads./sec). When the center of the wafer 30 is positioned a distance "r" away from the center of the polishing pad 17, the point velocity between the wafer 30 and the pad 17 at the center of the wafer is equal to the sum of the linear velocity $L_p$ of the pad ($W_p r$) and the translational velocity $V_t$ of the wafer. The relative velocity between the pad 17 and the wafer 30 generally increases from the center of the wafer 30 to its perimeter for the half of the wafer rotating counter to the pad, but it decreases for the half of the wafer rotating with the pad. The wafer planarizer 10 of the prior art illustrated in FIGS. 1 and 2 accordingly produces a center-to-edge velocity profile across the surface of the wafer 30. Additionally, since the removal rate of material from the wafer surface is related to the relative velocity between the pad surface and the wafer surface, conventional CMP machines and processes tend to remove a different amount of material from the perimeter of the wafer than from the center of the wafer.

Figure 3:
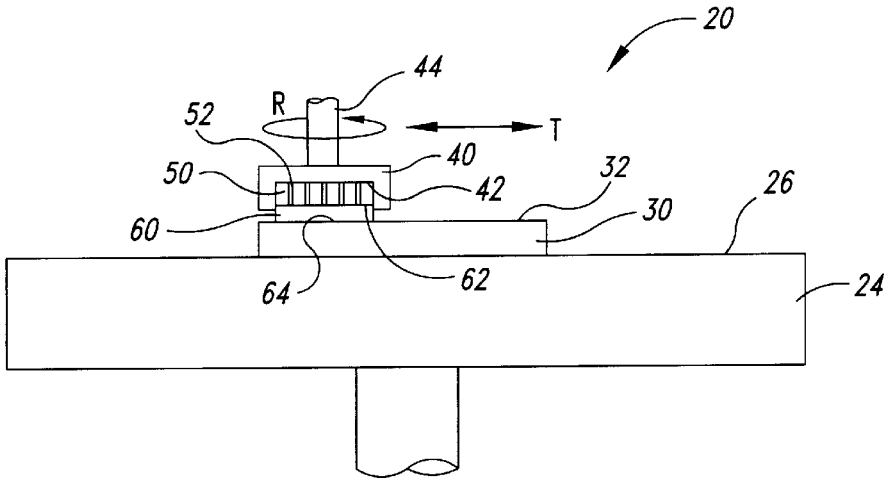
FIG. 3 is a schematic cross-sectional view of a planarizing apparatus in accordance with the invention.

FIG. 3 illustrates a planarizing apparatus 20 for chemical-mechanical planarization of a wafer 30 in accordance with the invention. The planarizing apparatus 20 has a platform 24, a pad carrier 40, and a polishing pad 60. The wafer 30 is mounted to an upper surface 26 of the platform 24, and the pad carrier 40 and pad 60 are positioned over the platform 24. The diameter of the pad 60 is preferably less than that of the wafer 30.

The pad carrier 40 has an actuator arm 44 attached to its upper surface and a pad socket 42 formed in its bottom surface. A perforated spacer 50 is attached to the upper portion of the pad socket 42, and the pad 60 is attached to the lower surface of the spacer 50. The spacer 50 and the pad 60 are securely attached to the pad carrier 40 by drawing a vacuum in the pad socket 42. The spacer 50 has a plurality of holes 52 through which the vacuum in the pad socket 42 draws the upper surface 62 of the pad 60 against the perforated spacer 50. The spacer 50 is preferably an optical flat that positions a planarizing surface 64 on the pad 60 substantially parallel to a plane defined by the upper surface 32 of the wafer 30.

Figure 4:
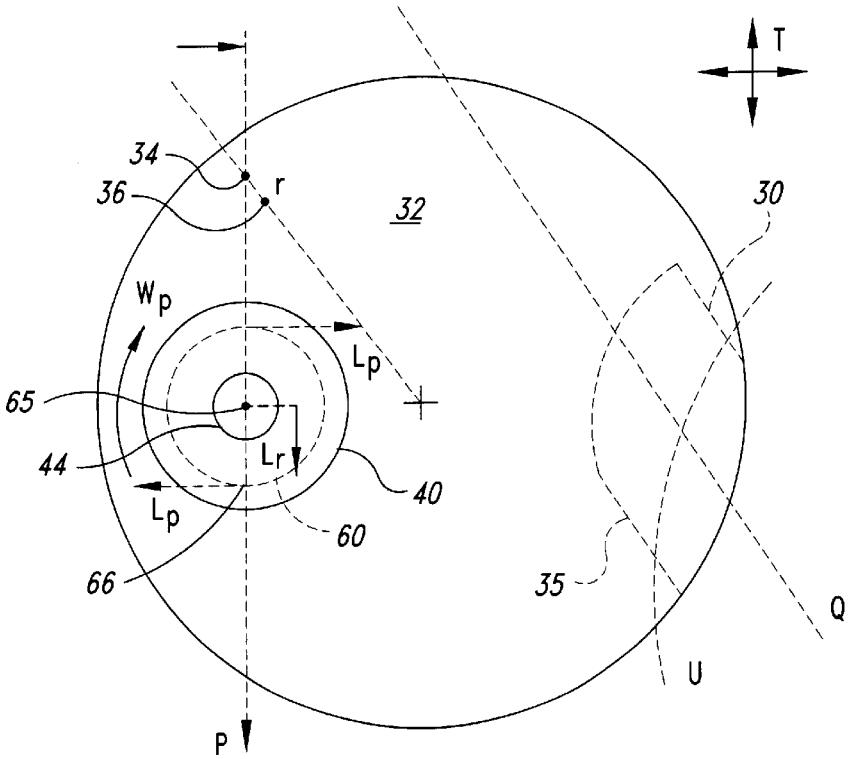
FIG. 4 is a top view of the planarizing apparatus of FIG. 3.

FIGS. 3 and 4 together illustrate the operation of the wafer planarizer 20. The pad carrier 40 is positioned over the wafer 30 so that the planarizing surface 64 of the pad 60 is positioned adjacent to the upper surface 32 of the wafer 30. The actuator arm 44 rotates the pad carrier 40 at an angular velocity $W_p$ in either direction indicated by arrow R. The actuator arm 44 also translates the pad carrier at a velocity of $V_t$ in the directions indicated by arrows T. As the pad 60 moves across the wafer 30, a slurry (not shown) is deposited onto the top surface 32 of the wafer 30.

Referring to FIG. 4, the profile of the point velocities across the wafer 30 does not allow a center-to-edge pattern because the wafer 30 is stationary during planarization. By holding the wafer stationary, the point velocities on the wafer are a function only of the radial distance between a point and the center of the pad 60. As the pad on the wafer and the center of the pad 60. As the pad moves along path P, for example, a point 34 aligned with the center 65 of the pad 60 on path P experiences a linear velocity of only $V_t$ at the center 65 of the pad. Another point 36 located radially inwardly from point 34 with respect to the center of the wafer 30 experiences a different linear velocity than that of point 34 because the center of the pad 60 does not pass over point 36. The pad 60 may be moved along various paths, such as paths P, Q and U, to distribute the point velocities randomly across the surface of the wafer 30. Thus, the present invention provides a random profile of point velocities across the wafer 30 so that no one region on the pad experiences a polishing rate that is substantially different from that of the other regions of the pad.

Moreover, the pad 60 is desirably moved along several paths across the surface of the wafer 30 so that the pad 60 passes over each point on the wafer 30 several times. For example, the pad 60 may be moved along paths Q and U to pass the pad 60 over all of the points in the region 35 at least twice. By making multiple passes over each point on the wafer, each point experiences multiple random velocities that result in an average point velocity for each point in the region 35 on the wafer 30. Accordingly, the present invention eliminates point velocity patterns and averages the point velocities across the surface of the wafer to provide a more uniform removal of material from the wafer.

Figure 5:
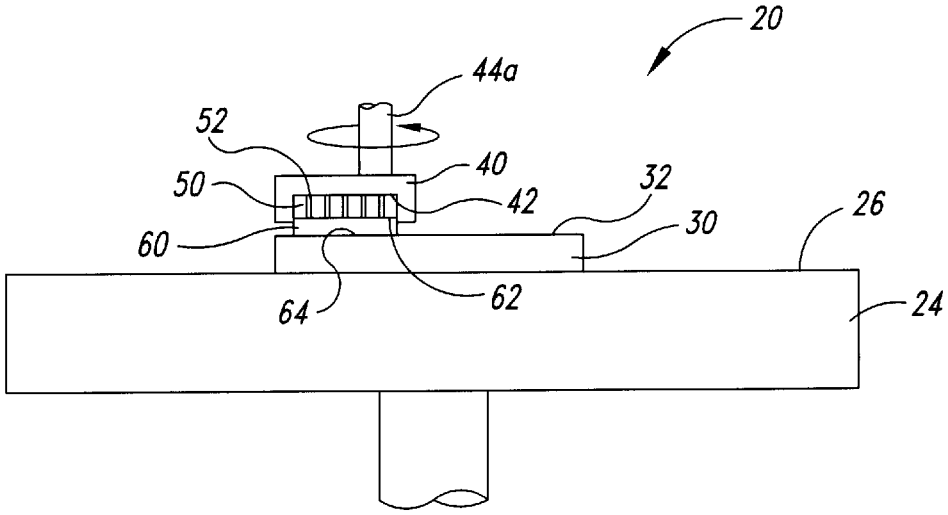
FIG. 5 is a schematic cross-sectional view of another planarizing apparatus in accordance with the invention.

FIG. 5 illustrates another embodiment of the planarizer 20 in which an off-center actuator arm 44(*a*) is attached to the upper surface of the pad carrier 40. The off-center actuator arm 44(*a*) moves the pad carrier 40 and pad 60 in an eccentric pattern across the top surface 32 of the wafer 30. By moving the pad 60 eccentrically across the wafer 30, the path of the pad 60 is more random than that of the centrally attached actuator arm 44 shown in FIGS. 3 and 4. Such a random path across the surface of the wafer 30 produces an even more uniform planarized surface 32 for the reasons discussed above.

Figure 6:
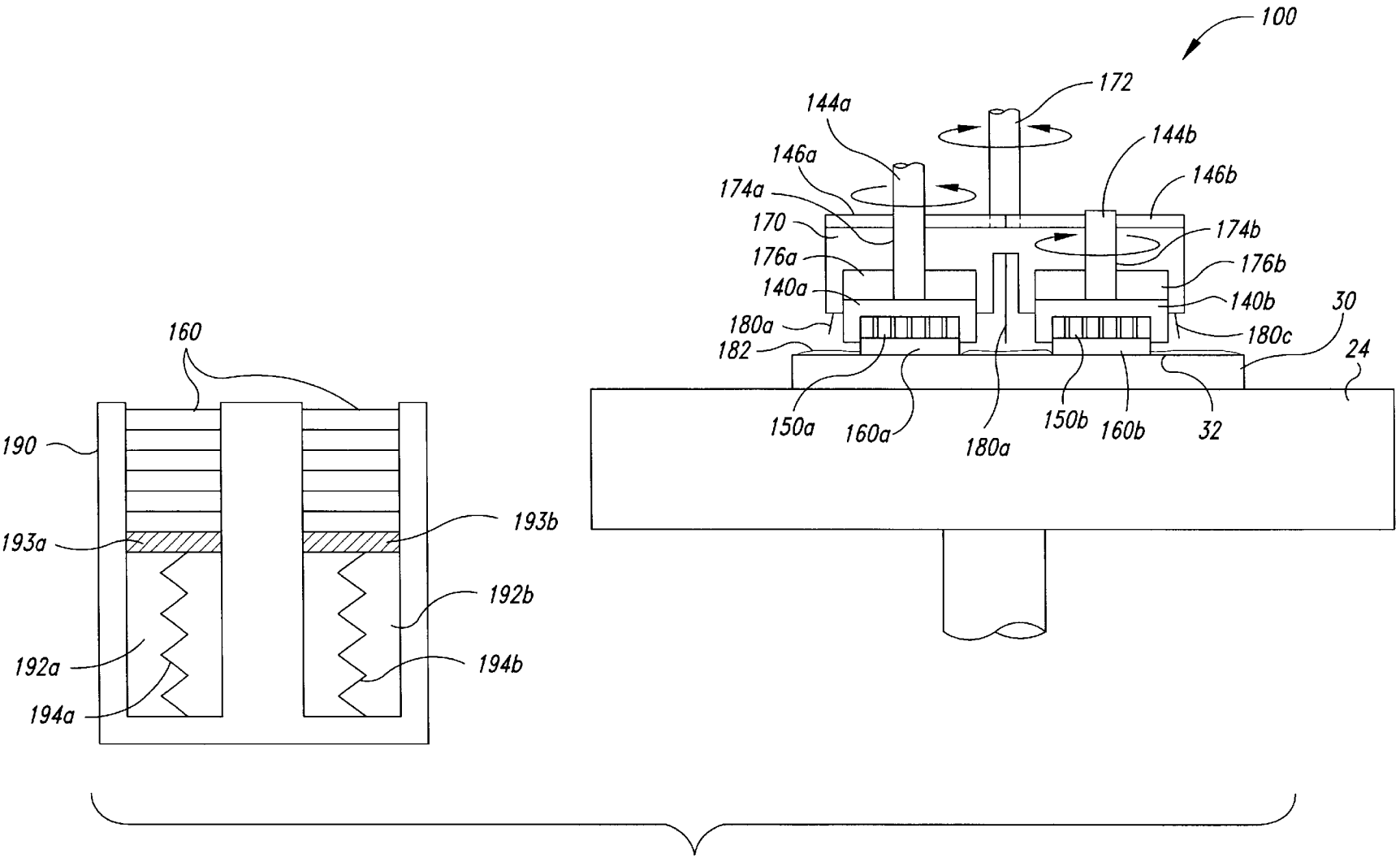
FIG. 6 is a schematic cross-sectional view of another planarizing apparatus in accordance with the invention.

FIG. 6 illustrates another embodiment of a multi-head planarizer 100 in accordance with the invention. The multi-head planarizer 100 has a platform 24, a turret 170, a plurality of pad carriers 140(*a*) and 140(*b*), and a plurality of pads 160(*a*) and 160(*b*). A wafer 30 is mounted to the platform 24, and the wafer 30 and the platform 24 are held stationary during the planarization process. The turret 170 holds a number of pad carriers and pads. In the embodiment shown in FIG. 6, the turret 170 has first and second recesses 176(*a*) and 176(*b*), and first and second bores 174(*a*) and 174(*b*). A turret actuator arm 172 attached to the top of the turret rotates and translates the turret 170 in a plane that is substantially parallel to the upper surface 32 of the wafer 30.

A pad carrier is received within each recess of the turret 170. Referring still to FIG. 6, the first pad carrier 140(*a*) is received in the first recess 176(*a*), and the second pad carrier 140(*b*) is received in the second recess 176(*b*). The turret 170 is not limited to holding two pad carriers 140(*a*) and 140(*b*), as a turret with three or more pad carriers is also within the scope of the invention. An active drive shaft 144(*a*) is attached to the pad carrier 140(*a*) and positioned in the first bore 174(*a*). Similarly, a passive drive shaft 144(*b*) is attached to the wafer carrier 140(*b*) and positioned in the second bore 176(*b*). A drive gear 146(*a*) is attached to the drive shaft 144(*a*), and a passive gear 146(*b*) is attached to the passive shaft 144(*b*). The active gear 146(*a*) engages the passive gear 146(*b*) so that the active drive shaft 144(*a*) counter rotates the passive shaft 144(*b*).

A number of perforated spacers and pads are attached to the pad carriers. A first perforated spacer 150(*a*) and the first pad 160(*a*) are attached to the first pad carrier 140(*a*) by a vacuum, as discussed above. Similarly, a second perforated spacer 150(*b*) and the second pad 160(*b*) are attached to the second pad carrier 140(*b*) by a vacuum. The diameter of each of the pads 160(*a*) and 160(*b*) in the multi-head planarizer 100 is less than the diameter of the wafer 30. In a preferred embodiment, the sum of the diameter of the pads 160(*a*) and 160(*b*) is also less than the diameter of the wafer 30. A number of slurry dispensers 180(*a*), 180(*b*), and 180(*c*) are positioned on the turret 170 to deposit a slurry solution 182 onto the upper surface 32 of the wafer 30.

A magazine 190 for holding a plurality of pads 160 is positioned near the platform 24. A number of pads 160 are positioned in first and second chambers 192(*a*) and 192(*b*) of the magazine 190. A first plug 193(*a*) positioned in the first chamber 192(*a*) is biased upwardly by a first spring 194(*a*), and a second plug 193(*b*) positioned in the second chamber 192(*b*) is biased upwardly by a second spring 194(*b*). After the pads 160(*a*) and 160(*b*) have planarized a wafer, they are removed from the wafer carriers 140(*a*) and 140(*b*) by a backside pressure created in the pad carriers 140(*a*) and 140(*b*). The multi-head planarizer 100 is then moved over the magazine 190, and new pads 160 are attached to the pad carriers 140(*a*) and 140(*b*) by drawing a vacuum against the top surface of the new pads.

Figure 7:
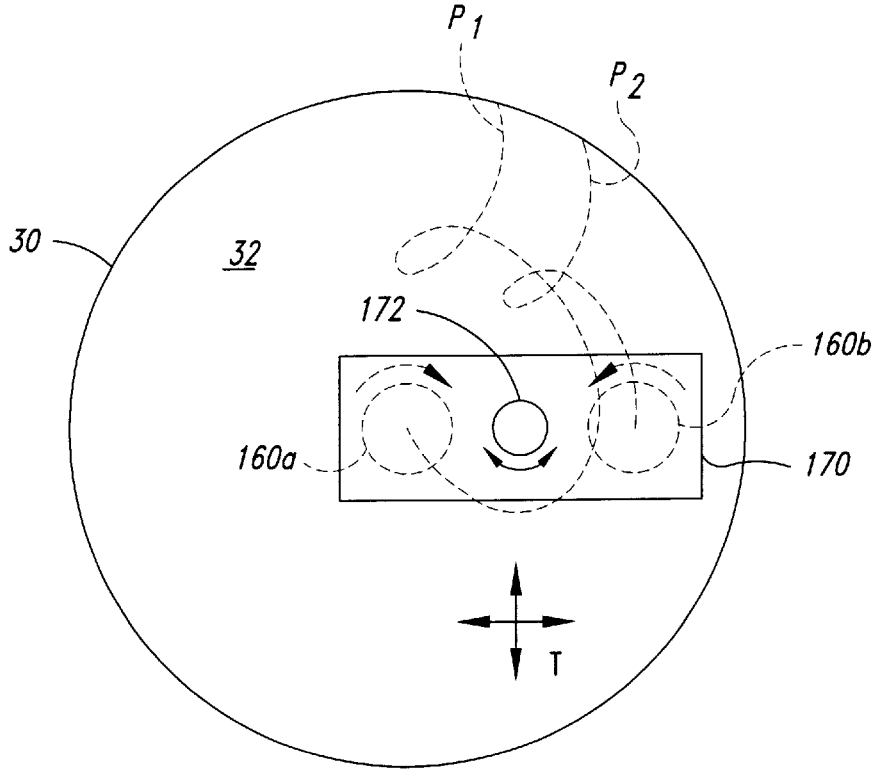
FIG. 7 is a top view of the planarizing apparatus of FIG. 6.

FIG. 7 illustrates the operation of a multi-head planarizer 100 with two pads 160(*a*) and 160(*b*). The pads 160(*a*) and 160(*b*) counter rotate with respect to one another, and the turret 170 rotates and translates over the wafer 30. The turret 170 moves the pads 160(*a*) and 160(*b*) in an eccentric pattern across the wafer 30, as shown by paths $P_1$ and $P_2$. The pads 160(*a*) and 160(*b*) accordingly pass over any given point on the upper surface 32 of the wafer 30 multiple times and in a highly asymmetrical pattern. The multi-head planarizer 100, therefore, substantially eliminates the center-to-edge velocity profile of conventional planarizers.

Figure 8:
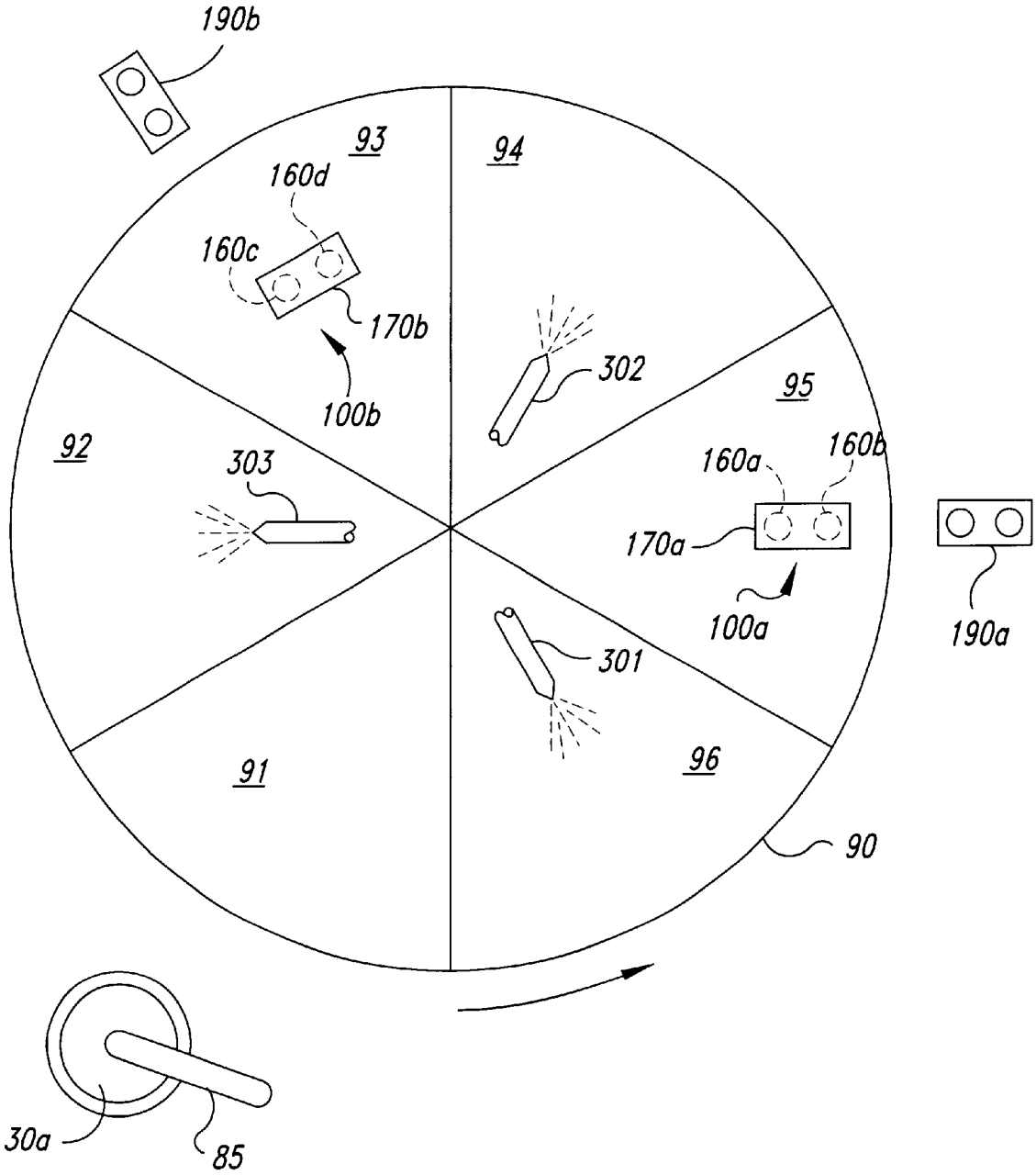
FIG. 8 is a schematic top view of a multi-station planarizing and rinsing apparatus in accordance with the invention.

FIG. 8 illustrates another embodiment of the invention in which the platform is moveable and has a number of wafer processing stations for simultaneously planarizing and rinsing a plurality of wafers. In one embodiment, the platform is a rotating carrousel 90 with six workstations 91–96, respectively. The platform may alternatively be a belt or other mechanism that translates the work stations linearly (not shown), or it may be a separate, moveable plate that is passed from one workstation to the next by a robot (not shown). In the start up position, the first station 91 is positioned adjacent to a wafer loader 85, and a number of wafers 30 are held in the wafer loader 85. The sixth workstation 96 is positioned under a pre-rinse nozzle 301; the fifth workstation 95 is positioned under a first multi-head planarizer 100(*a*) and adjacent to a first pad magazine 190(*a*); the fourth workstation 94 is positioned under a primary rinse nozzle 302; the third station 93 is positioned under a second multi-head planarizer 100(*b*) and adjacent to a second pad magazine 190(*b*); and the second workstation 92 is positioned under a final-rinse nozzle 303.

In operation, the carrousel 90 selectively positions a plurality of wafers proximate to appropriate devices to simultaneously planarize and rinse the wafers in a desired sequence. At the start of the process, the wafer loader 85 loads the first wafer 30(*a*) onto the first station 91, and then the carrousel 90 rotates counter-clockwise to position the first wafer 30(*a*) under the pre-rinse nozzle 301. The wafer loader 85 then loads another wafer onto the second station 92, and the pre-rinse nozzle 301 sprays the first wafer 30(*a*) in a pre-rinse cycle. The carrousel 90 rotates again so that the first wafer 30(*a*) is positioned under the first multi-head planarizer 100(*a*). The carrousel 90 continuously indexes the wafers to an appropriate device so that a number of wafers may be simultaneously pre-rinsed, planarized, primary-rinsed, final-planarized, final-rinsed, and unloaded/loaded.

Figure 9:
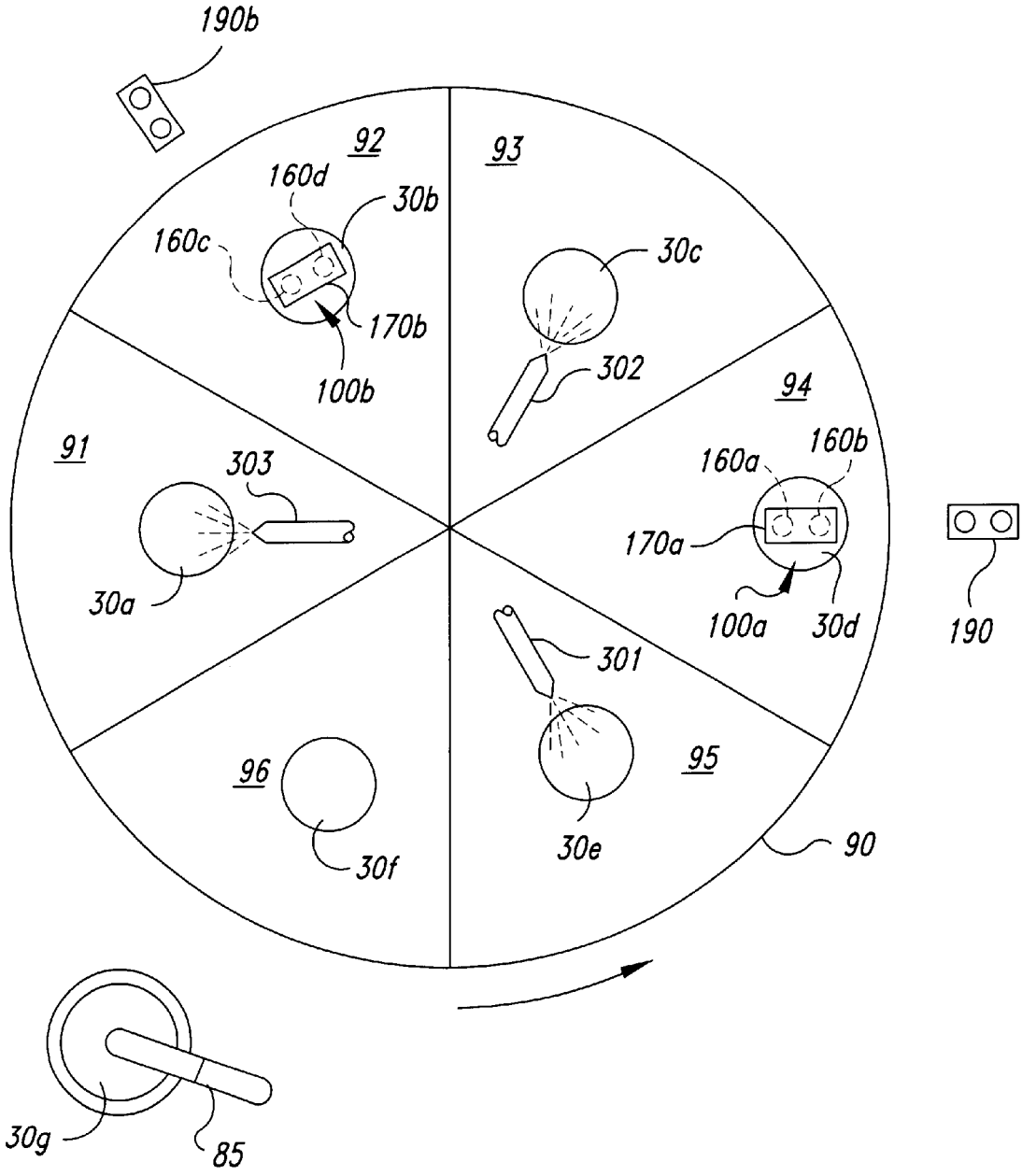
FIG. 9 is a schematic top view of a multi-station planarizing and rinsing apparatus in accordance with the invention.

FIG. 9 illustrates the carrousel 90 after the first station 91 and the first wafer 30(*a*) have proceeded to the final rinse nozzle 303 for the final-rinse stage of the CMP process. A second wafer 30(*b*), which was mounted to the second station 92, is positioned under the second multi-head planarizer 100(*b*) for its final-planarization. A third wafer 30(*c*), which was mounted to the third station 93, is positioned under the primary-rinse nozzle 302 for the primary-rinse stage of the CMP process. A fourth wafer 30(*d*), which was mounted to the fourth stage 94, is positioned under the first planarizer 100(*a*) for its primary-planarization. A fifth wafer 30(*e*), which was mounted to the fifth station 95, is positioned under the pre-rinse nozzle 301 for the pre-rinse stage before it is planarized. A sixth wafer 30(*f*), is mounted to the sixth station 96 to begin the CMP process. It will be appreciated that the carrousel planarizing and rinsing apparatus shown in FIGS. 8 and 9 simultaneously performs the pre-rinsing, planarizing, primary-rinsing, final-planarizing, final-rinsing, and loading/unloading steps of a full CMP process.

One advantage of the present invention is that the carrousel 90 provides parallel processing of several wafers. As shown by FIGS. 8 and 9, five wafers may be simultaneously rinsed and planarized using the high-speed planarizers 100(*a*) and 100(*b*) in combination with the carrousel 90. The parallel processing of several wafers is made possible because the planarizers 100(*a*) and 100(*b*) are substantially smaller than conventional CMP planarizing equipment. The primary reason for the size differential is that the planarizers 100(*a*) and 100(*b*) use pads with less than 8.0 inch diameters, while conventional machines use pads 2.0 feet in diameter. Accordingly, a reasonably small carrousel 90 may be used to simultaneously rinse and planarize several wafers to increase the throughput of the CMP process.

Another advantage of the present invention is that it eliminates the center-to-edge velocity profile across the surface of the wafer. By holding the wafer stationary during planarization, and by providing a pad that is smaller than the wafer, the pad may move randomly across the face of the wafer 30 and pass over any given point on the wafer 30 several times. The point velocities on the wafer are randomly distributed eliminate point velocity patterns across the wafer. Unlike conventional CMP planarizers, therefore, the perimeter of a wafer will not have consistently different point velocities and polishing rates than the center of the wafer.

As discussed above, the elimination of the center-to-edge velocity profile will produce a more uniform surface on the wafer because the slurry distribution and temperature will be more uniform across the face of the wafer. Moreover, without a center-to-edge velocity profile, the planarizing machines of the invention can achieve higher polishing rates because the pads may be rotated at much higher angular velocities compared to conventional CMP machines.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A planarizing apparatus for planarizing microelectronic-device substrate assemblies, comprising:

a platform upon which a substrate assembly can be mounted and held stationary during planarization;

a turret assembly positioned over the platform, the turret assembly being translatable in a plane at least substantially parallel to the substrate assembly and rotatable about a turret rotation axis in a first rotational direction, and the turret assembly having a first station spaced apart from the turret rotation axis and a second station spaced apart from the turret rotation axis, the first and second stations orbiting about the turret rotation axis as the turret rotates in the first rotational direction;

a first pad carrier attached to the turret assembly at the first station that rotates in the first rotational direction about a first pad rotation axis through the first station;

a first pad attached to the first pad carrier;

a second pad carrier attached to the turret assembly at the second station that rotates in a second rotational direction counter to the first rotational direction about a second pad rotation axis through the second station; and a second pad attached to the second pad carrier.

2. The planarizing apparatus of claim 1 wherein the turret assembly further comprises a third station spaced apart from the turret rotation axis to orbit about the turret rotation axis, and wherein the planarizing apparatus further comprises a third pad carrier attached to the turret assembly at the third station and a third pad attached to the third pad carrier.

3. The planarizing apparatus of claim 2 wherein the third pad carrier rotates about a third pad carrier axis in one of the first or second rotational directions.

4. The planarizing apparatus of claim 1 wherein the first and second pads each have a pad diameter less than a substrate diameter of the substrate assembly.

5. The planarizing apparatus of claim 1 wherein the first and second pads each have a pad diameter, and wherein the sum of the pad diameters of the first and second pads is less than a substrate diameter of the substrate assembly.

6. A planarizing apparatus for planarizing microelectronic-device substrate assemblies, comprising:

a platform upon which a substrate assembly can be mounted and held stationary during planarization;

a turret assembly positioned over the platform, the turret assembly being translatable in a plane at least substantially parallel to the substrate assembly and rotatable about a turret rotation axis in a first rotational direction, and the turret assembly having a first station spaced apart from the turret rotation axis and a second station spaced apart from the turret rotation axis, the first and second stations orbiting about the turret rotation axis as the turret rotates in the first rotational direction;

a first pad carrier attached to the turret assembly at the first station that is separately rotatable and rotates in the first rotational direction about a first pad axis off-set from the turret rotational axis;

a first polishing pad attached to the first pad carrier;

a second pad carrier attached to the turret assembly at the second station that is separately rotatable and rotates in a second rotational direction counter to the first rotational direction about a second pad axis off-set from the turret rotational axis and the first pad axis; and a second polishing pad attached to the second pad carrier.

7. The planarizing apparatus of claim 6 wherein the turret assembly further comprises a third station spaced apart from the turret rotation axis to orbit with respect to the turret rotation axis, and wherein the planarizing apparatus further comprises a third pad carrier attached to the turret assembly at the third station and a third pad attached to the third pad carrier.

8. The planarizing apparatus of claim 7 wherein the third pad carrier rotates about a third pad carrier axis in one of the first or second rotational directions.

9. The planarizing apparatus of claim 6 wherein the first and second pads each have a pad diameter less than a substrate diameter of the substrate assembly.

10. The planarizing apparatus of claim 6 wherein the first and second pads each have a pad diameter, and wherein the sum of the pad diameters of the first and second pads is less than a substrate diameter of the substrate assembly.

11. A method of planarizing a microelectronic-device substrate assembly, comprising:

holding the substrate assembly stationary;

pressing a first polishing pad against a face of the substrate assembly in the presence of a planarizing solution, the first polishing pad having a first central point;

rotating the first polishing pad about a first pad rotational axis passing through the first central point of the first polishing pad;

orbiting the first polishing pad about a primary rotational axis in a first rotational direction, the primary rotational axis being spaced apart from the first central point of the first polishing pad;

pressing a second polishing pad against the face of the substrate assembly in the presence of the planarizing solution, the second polishing pad having a second central point spaced apart from the primary rotational axis;

rotating the second polishing pad about a second pad rotational axis passing through the second central point of the second polishing pad;

orbiting the second polishing pad about the primary rotational axis in the first rotational direction;

rotating the first polishing pad in the first rotational direction in which the first and second polishing pads orbit about the primary rotational axis, and the second pad in a second rotational direction counter to the first rotational direction; and translating the first and second polishing pads with respect to the substrate assembly in a plane at least substantially parallel to the substrate assembly in a pattern that produces a substantially random pattern of point velocities across the substrate assembly.

* * * * *